United States Patent [19]

Humbert

[11] 4,281,368

[45] Jul. 28, 1981

[54] KEYHOLE ILLUMINATING APPARATUS

[76] Inventor: A. Robert Humbert, 5514 S. Adams St., Marion, Ind. 45952

[21] Appl. No.: 90,681

[22] Filed: Nov. 2, 1979

[51] Int. Cl.[3] ..... E05B 17/10

[52] U.S. Cl. ..... 362/100; 362/203; 362/205; 362/206

[58] Field of Search ..... 362/100, 102, 190, 191, 362/202–206, 208, 370, 125; 428/31

[56] References Cited

U.S. PATENT DOCUMENTS

| | | | |
|---|---|---|---|
| 1,404,259 | 1/1922 | Alschuler | 362/206 |
| 1,472,088 | 10/1923 | Puckett | 362/202 |
| 2,070,316 | 2/1937 | Recker | 362/206 |
| 2,699,490 | 1/1955 | Reap | 362/100 |
| 2,732,480 | 1/1956 | Wells | 362/100 |
| 2,765,396 | 10/1956 | Iverson | 362/100 |
| 3,071,747 | 1/1963 | Moore | 362/206 |
| 3,679,886 | 7/1972 | Pizzey | 362/100 |
| 3,856,609 | 12/1974 | Maas | 428/11 |
| 4,173,035 | 10/1979 | Hoyt | 362/125 |
| 4,178,712 | 12/1979 | Williams | 362/194 |
| 4,742,207 | 6/1973 | Strauss | 362/206 |

FOREIGN PATENT DOCUMENTS

| | | | |
|---|---|---|---|
| 533189 | of 1941 | United Kingdom | 362/100 |

*Primary Examiner*—Charles T. Jordan
*Assistant Examiner*—Edward F. Miles

[57] ABSTRACT

Disclosed is a tubular housing having a threaded-base lamp bulb at one end and a "penlite" battery within the housing with its positive terminal stud separated from the bulb's positive terminal by a helical compression spring. The spring coils receive the lamp base and the spring is bottomed and centered in an annular retainer disc encircling the positive terminal stud of the battery. A conductive strap engages the endmost coil of the spring and extends the length of the battery to its base providing electrical continuity from the battery negative terminal to the bulbs threaded base. A push button, accessible at the end of the housing, moves the battery so that its positive terminal engages the positive terminal of the bulb.

8 Claims, 6 Drawing Figures

KEYHOLE ILLUMINATING APPARATUS

BACKGROUND OF THE INVENTION

Keyhole illuminating devices are well known in the art. Typical of the patents showing such devices, in which the positive battery terminal is held away from the bulb terminal by a helical compression spring and the battery is bodily moved to engage the bulb, is U.S. Pat. No. 2,765,396. Other patents directed to keyhole illuminating devices are U.S. Pat. Nos. 2,699,490 and 2,732,480.

The apparatus of the present invention represents an improvement over prior moveable-battery type devices in that it utilizes a one-piece molded barrel or housing, the junctional area between the moveable switch button or pin and the housing is weather proof, and a thin conductive strap extending the length of the battery provides electrical continuity to the bulb. Further, the curved nose assembly and a retainer disc, adjacent the end of the battery, keeps the bulb and spring centered in the bore of the housing. A minimum number of economically formed and assembled component parts characterizes the apparatus and the result is a device having a long, service-free, operating life.

DESCRIPTION OF THE PREFERRED EMBODIMENT

Figure 1:
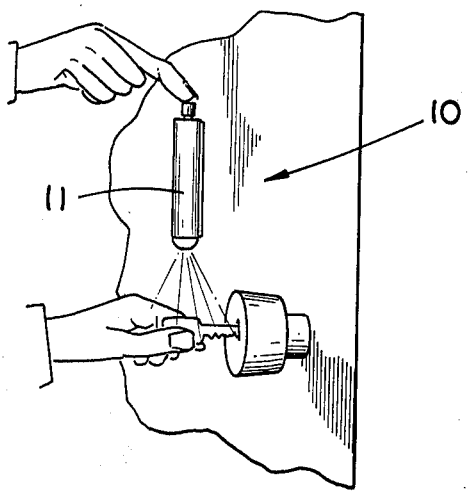
FIG. 1 is a perspective view illustrating the apparatus of the present invention in use.
Figure 2:
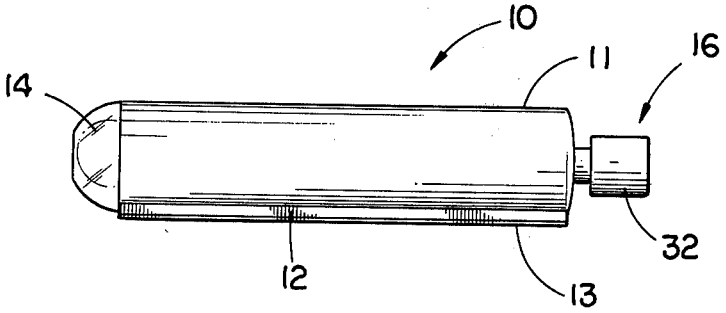
FIG. 2 is a side view of the apparatus.
Figure 3:
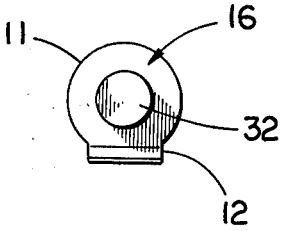
FIG. 3 is an end view of the apparatus showing the push button or pin controlling energization of the bulb.

Referring initially to FIGS. 1 and 2, the apparatus 10 includes a tubular housing 11 adapted for mounting on an adjacent surface by means of the flattened area 12 carrying a pressure sensitive adhesive 13. As may be seen in FIG. 1, upon actuation, the device illuminates the keyhole area on a door or the like.

Figure 4:
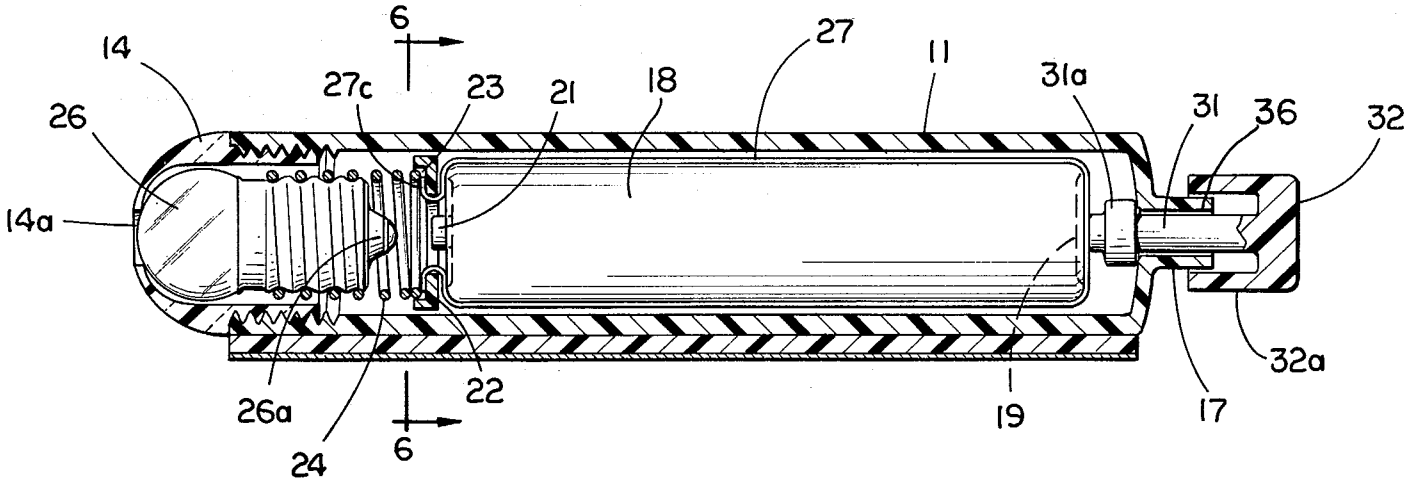
FIG. 4 is a side sectional view of the apparatus

As FIGS. 2 and 4 indicate, one end of the housing is threaded to removably receive a translucent closure cap 14 having a curved end surface and a central aperture 14*a*. An axially movable actuating member, shown generally at 16, extends from a sleeve 17 which is integral with the housing 11.

As may be seen in FIG. 4, a battery 18, which may be of conventional AA "Penlite" type, is disposed in housing 11. The battery negative terminal is the end wall 19 and its positive terminal is formed by the stud 21. An annular retainer disc 22, formed of electrical insulating material, overlies the adjacent end of the battery and encircles the terminal stud 21. The disc is counterbored to provide an annular groove 23 in the face of the disc remote from the battery. The shoulder formed at the base of the groove serves to center and bottom the adjacent end of a helical compression spring 24. The opposite end of the spring receives the threads in the threaded base of a conventional non-focusing flashlight bulb 26 having a curved glass surface and a central, positive terminal 26*a* which is adapted to engage, when spring 24 is sufficiently compressed, the battery terminal stud 21. It will be noted that spring 24 is sized so that the coils of the spring closely receive the threads on the bulb base and the spring forms the socket for the bulb, the threaded base of the bulb acting as the bulb's negative terminal. The curved glass surface of the bulb is axially centered by the aperture 14*a* and adjacent curved surface of the translucent closure cap 14.

Figure 5:
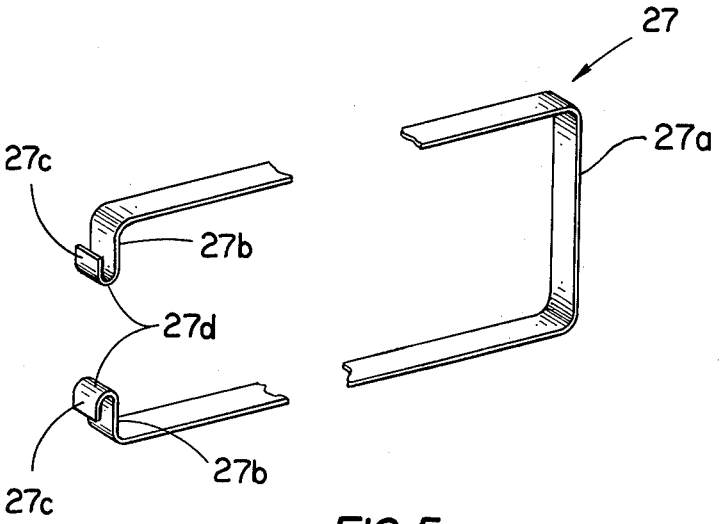
FIG. 5 is a perspective view of the conductive member component of the apparatus.

Electrical continuity between the negative battery terminal 19 and the spring 24 is formed by the generally U-shaped, conductive member or strap 27 which may be formed of beryllium copper and whose general contour is best shown in FIG. 5. The member 27 extends along the sidewall of the battery, its base 27*a* overlying the battery end wall 19 and the leg portions 27*b* (FIG. 5) are directed inwardly and formed to extend through the central aperture in the disc 22. The tips of the legs are reversely bent to form end portions 27*c* which overlie and are exposed at the base of the annular groove 23 in the disc, that is, the face of the disc remote from the battery.

Figure 6:
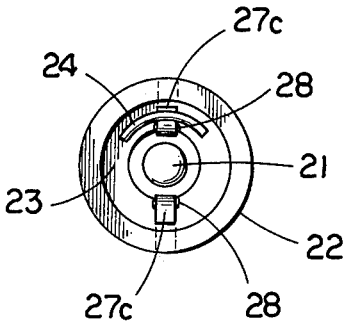
FIG. 6 is a top plan view of the annular retainer disc taken generally along the line 6—6 of FIG. 4.

As may best be seen in FIG. 6, to retain member 27 against lateral displacement and to assure that member 27 does not contact battery terminal 21, the outwardly extending sections 27*d* of the leg portions 27*b* extend through diametrically opposed notches 28 at the central opening in the annular disc 22. The end portions 27*c* underlie, and make electrical contact with, the endmost coil of the spring 24 providing electrical continuity to the threaded bulb base.

The axially moveable actuating member for energizing bulb 26 takes the form of the push pin or rod 31 which extends, with a slight clearance, through the sleeve 17. A shoulder 31*a* on the pin defines the limit of extension of the pin from the housing. The inner end of the pin engages the portion of strap 27 which spans the end wall 19 of the battery. The outer end of the pin carries a cap 32 having a depending tubular portion 32*a* which accomodates the sleeve 17, sliding over the sleeve when the pin 31 is depressed to move into the housing 11.

In operation, with the housing mounted on a support surface, such as a door casing as shown in FIG. 1, the components of the apparatus will be in the general positions shown in FIG. 4, bulb 26 being deenergized because of the separation of its terminal 26*a* from the positive battery terminal 21. To energize the bulb the cap member 32 is depressed moving pin 31 inwardly and bodily moving battery 18 leftward (as viewed in FIG. 4). This movement of the battery continues, compressing spring 24, until battery stud 21 engages bulb terminal 26*a* energizing the bulb. When cap 32 is released, spring 24 returns the battery and the other moveable components to their position of FIG. 4 deenergizing the bulb.

It will be noted that the pressing of the underface of the base of the conductive strap 27 into the battery end wall 19 by the tip of pin 31 assures good electrical contact with the negative terminal (wall 19) of the battery. Further, the slight clearance 36 between pin 31 and the surrounding sleeve 17 permits a slight random variation in the position or angle at which the tip of pin 31 engages the underlying portion of member 27 and thus produces a slight cutting engagement of the edges of member 27 with the battery base wall 19. This pierces the oxide coating which tends to build on the battery endwall and assures good, continued electrical contact between these elements even if intervals between actuation of the apparatus are prolonged.

The cap member 32 closely fitting the sleeve 17 assures that, particularly when the assembly is mounted vertically as shown in FIG. 1, the area of entry of the pin 31 into the housing is weatherproof. The conductive strap 27 is shaped to have assured contact with the endmost coil of spring 24 and the notches 28 in disc 22 retain member 27 against lateral displacement and space it from the battery terminal 21 to avoid short-circuiting of the battery. The grooved, insulating disc 22 centers the spring and bulb and anchors both the spring and the member 27 in the housing. The battery and bulb may be easily replaced by unscrewing cap member 14 from the housing. The location of the actuating member (cap 32) at the top end of the assembly when mounted as shown in FIG. 1, enables the user to locate the actuating element in the dark by touch. The apparatus is neat and unobtrusive in over-all appearance and its internal construction, as described above, provides a prolonged, trouble-free service life.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A keyhole illumination apparatus comprising an elongated tubular housing adapted for mounting on a surface adjacent a keyhole, a translucent closure cap removably fastened in one end of said housing and an axially moveable actuating member extending from the other end of the housing, a cylindrical battery within the housing having a central positive terminal stud at one end with its opposite end wall forming the negative terminal, an annular retainer disc encircling said positive terminal stud, an electrically conductive thin metal strap overlying and extending from said opposite end wall of the battery to said disc and anchored to the disc with a portion of the strap exposed at the face of the disc remote from the battery, a helical wire compression spring carrying at one end an electrical bulb having positive and negative terminals, said spring extending within said housing bottomed on said disc and electrically contacting the negative bulb terminal and said exposed portion of the conductive strap, the positive bulb terminal at the base of the bulb being aligned with said central positive battery terminal, said spring being stressed so that it exerts an axial force urging said battery toward said other end of the housing and said bulb against said closure cap, depression of said actuating member bodily moving said battery against the force exerted by said spring and engaging the positive terminals of the bulb and battery to energize the bulb.

2. An apparatus as claimed in claim 1 in which said electrically conductive strap has a generally U-shaped configuration whose base overlies and engages said opposite end wall of the battery and whose free ends extend through the central aperture in said annular retainer disc.

3. An apparatus as claimed in claim 1 in which said bulb is of the threaded base type and said helical spring is sized so that its coils receive the bulb base threads.

4. An apparatus as claimed in claim 1 in which said actuating member comprises a pin slidably moveable in a sleeve, said sleeve being coaxial with said housing and extending from said opposite end thereof, a cap member carried on the outer end of said pin having a tubular portion closely fitting over said sleeve and moveable along the sleeve as said pin moves in the housing, whereby the region of entry of the pin in the housing is made weatherproof.

5. An apparatus as claimed in claim 1 in which said actuating member comprises a pin slidably moveable in a sleeve, said sleeve being coaxial with said housing and extending from said opposite end thereof, said pin engaging the base of said conductive strap overlying said opposite end wall of the battery, said sleeve and pin having a clearance therebetween to produce a wiping action as said conductive strap engages said opposite battery end wall upon movement of the pin into the housing.

6. A keyhole illumination apparatus comprising an elongated tubular housing adapted for mounting on a surface adjacent a keyhole, a translucent closure cap removably fastened in one end of said housing and an axially moveable actuating member extending from the other end of the housing, a cylindrical battery within the housing having a central positive terminal stud at one end with its opposite end wall forming the negative terminal, an annular retainer disc encircling said positive terminal stud, an electrically conductive member overlying and extending from said opposite end wall of the battery to said disc and anchored to the disc with a portion of the member exposed at the face of the disc remote from the battery, a helical wire compression spring carrying at one end an electrical bulb having positive and negative terminals, said spring extending within said housing bottomed on said disc and electrically contacting the negative bulb terminal and said exposed portion of the conductive member, the positive bulb terminal at the base of the bulb being aligned with said central positive battery terminal, said spring being stressed so that it exerts an axial force urging said battery toward said other end of the housing and said bulb against said closure cap, depression of said actuating member bodily moving said battery against the force exerted by said spring and engaging the positive terminals of the bulb and battery to energize the bulb, said annular disc being provided with means for axially aligning said bulb and spring with the housing, said means comprising an annular groove formed in said disc, the groove receiving the endmost coil of said compression spring.

7. An apparatus as claimed in claim 6 in which said portion of said conductive strap exposed at said remote face of the disc is formed by extension of said strap through the central aperture of said annular disc with an end portion bent to overlie the base of said annular groove in the disc and to engage the adjacent coil of said spring.

8. An apparatus as claimed in claim 7 in which the leg portions of said conductive strap pass through diametrically opposed notches at said central aperture of the disc member to resist lateral displacement of the conductive strap.

* * * * *